United States Patent [19]

Ogawa et al.

[11] Patent Number: 4,551,412

[45] Date of Patent: Nov. 5, 1985

[54] SILVER HALIDE PHOTOGRAPHIC LIGHT-SENSITIVE MATERIAL FOR PHOTOMECHANICAL PROCESS AND METHOD OF REDUCTION TREATMENT THEREFORE

[75] Inventors: Masashi Ogawa; Taku Nakamura; Yukihide Urata; Shingo Yamauchi, all of Minami-Ashigara, Japan

[73] Assignee: Fuji Photo Film Co., Ltd., Kanagawa, Japan

[21] Appl. No.: 524,001

[22] Filed: Aug. 17, 1983

[30] Foreign Application Priority Data

Aug. 17, 1982 [JP] Japan ..... 57-142464

[51] Int. Cl.[4] ..... G03C 1/48

[52] U.S. Cl. ..... 430/265; 430/264; 430/266; 430/949; 430/533

[58] Field of Search ..... 430/265, 264, 266, 949, 430/533

[56] References Cited

U.S. PATENT DOCUMENTS 3,142,568 7/1964 Nottorf ..... 430/949
3,411,911 11/1968 Dykstra ..... 430/535

FOREIGN PATENT DOCUMENTS 2108695A 5/1983 United Kingdom ..... 430/265

*Primary Examiner*—Won H. Louie
*Attorney, Agent, or Firm*—Sughrue, Mion, Zinn, Macpeak, and Seas

[57] ABSTRACT

A silver halide photographic light-sensitive material for photo-mechanical process comprising a support having thereon at least one light-sensitive silver halide emulsion layer and at least one light-insensitive upper layer which is positioned above the light-sensitive silver halide emulsion layer, wherein at least one of the light-insensitive upper layers has a melting time longer than a melting time of the light-sensitive silver halide emulsion layer and the light-insensitive upper layer contains a polymer latex.

The silver halide photographic light-sensitive material has excellent aptitude for reduction treatment without increasing the amount of silver per unit area. The occurrence of reticulation is prevented with the silver halide photographic light-sensitive material.

A method of reduction treatment for a silver halide photographic light-sensitive material for photo-mechanical process comprising the steps of: exposing the silver halide photographic light-sensitive material as described above, development processing the exposed silver halide photographic light-sensitive material to form a silver image, and carrying out reduction treatment of the silver image is also disclosed.

27 Claims, No Drawings

SILVER HALIDE PHOTOGRAPHIC LIGHT-SENSITIVE MATERIAL FOR PHOTOMECHANICAL PROCESS AND METHOD OF REDUCTION TREATMENT THEREFORE

FIELD OF THE INVENTION

The present invention relates to a silver halide photographic light-sensitive material for photo-mechanical process (hereinafter referred to as "light-sensitive material for photo-mechanical process"). More particularly, it relates to a light-sensitive material for photo-mechanical process which has excellent aptitude for reduction treatment and with which the occurrence of reticulation is remarkably decreased.

BACKGROUND OF THE INVENTION

The light-sensitive materials for photo-mechanical process are light-sensitive materials used in a photographic photo-mechanical process step in the printing industry, such as for converting a continuous light-shade image into a dot image or photo-graphing a line drawing, etc.

When such light-sensitive materials for photo-mechanical process are used for making printing plates, a treatment called reduction treatment is frequently conducted. This treatment is performed in order to obtain delicate reproduction of tone or satisfy artistic expression of the images adapting to printing characteristics, by which fine correction of images is carried out partially or completely. The corrections may include reduction of the area of dots or widening or narrowing of the width of a line drawing.

Therefore, aptitude for reduction treatment is a very important property in light-sensitive materials for photo-mechanical process.

When carrying out reduction treatment of light-sensitive materials for photo-mechanical process having dot images or line drawing images formed by exposure and development processing, it has been known to use a method which comprises contacting metal silver forming the dot images or line drawing images with a reducer. Various kinds of reducers are known. For example, reducers using a reducing component such as a permanganate, a ferric salt, a cerium (IV) salt, a ferricyanide, a bichromate or a persulfate, etc., have been described in Mees, *The Theory of the Photographic Process,* pages 738–739 (1954, published by Macmillan Co.).

Reduction treatment is a treatment comprising oxidizing silver images by a reducer to dissolve them. Accordingly, when dot images are subjected to reduction treatment, the decrease in dot area is achieved along with a decrease in the blank density of the dots. Therefore, the extent to which dot images can be corrected by the reduction treatment is restricted by a degree of the decrease in blank density of each dot which occurs together with the decrease in dot area. In other words, a measure of the extent to which dot image can be corrected can be represented by a reduction of dot area while maintaining the black density of each dot at a specified value or more.

In the present specification, the term "reduction width" means a decrease in dot area from the dot area before the reduction treatment when the black density of the dots is decreased by the reduction treatment to the lowest value necessary for the photographic photomechanical process step. Thus, the wider the reduction which is, the higher the reduction treatment aptitude is.

A method for improving reduction treatment aptitude is described, for example, in Japanese Patent Application (OPI) No. 68419/77. A mercapto compound is used for the reduction treatment. However, the reducer is specific and difficult to use, because its reduction rate is different from that of conventionally used reducers. Further, it is possible to widen the reduction width resulting in the improvement in reduction treatment aptitude while increasing the density due to increase in the covering power by softening the emulsion membrane. However, the required film strength cannot be obtained by this method.

The most effective method for improving the reduction treatment aptitude due to widening the reduction width is increasing the silver content for forming the images. This method is effective because the ability to correct images by the reduction treatment is generally increased when there is a greater amount of silver in the silver images per unit area, where, as described above, the reduction treatment comprises oxidizing silver images by a reducer to dissolve them. Therefore, the reduction width can be increased when a coating amount of silver halide per unit area in the light-sensitive material for photo-mechanical process to be used is increased. However, since silver is very expensive and rare, increasing the coating amount of silver is not preferred in view of the cost of the light-sensitive materials for photo-mechanical process and economy of resources.

Accordingly, it is an important subject in this field to produce a light-sensitive material for photo-mechanical process having the required properties while using silver in an amount as low as possible.

As a result of extensive investigations relating to improving such problems, it has been found that widening the reduction width and thus remarkable improvement in the reduction treatment aptitude can be achieved where the hardness of the light-insensitive upper layer is increased utilizing a hardening technique capable of controlling the hardness of the light-insensitive upper layer and that of the silver halide emulsion layer, separately (i.e., selective hardening technique of the coating layers) as described in Japanese Patent Application (OPI) No. 42039/83 (corresponding to British Pat. No. 2,108,605A).

When dealing with a multilayer coating material, if the upper layer is hardened so as to have a hardness higher than that of the lower layer, network patterns called "reticulation" occur, when high temperature treatment with an exhausted processing solution is utilized (edited by R. J. Cox, Jojo et al., *Photographic Gelatin,* pages 49–61 (1972), Academic Press). Accordingly, it is desirable to prevent the occurrence of reticulation for the light-sensitive material for photo-mechanical process in which the reduction treatment aptitude is improved utilizing the selective hardening technique of the coating layers.

SUMMARY OF THE INVENTION

Therefore, an object of the present invention is to provide a light-sensitive material for photo-mechanical process in which the reduction treatment aptitude is improved without using the means of increasing the coating amount of silver and in which the occurrence of reticulation is prevented.

Another object of the present invention is to provide a method of reduction treatment having a wide reduction width when using a light-sensitive material for photo-mechanical process.

Other objects of the present invention will be apparent from the following detailed description and examples.

These objects of the present invention can be attained by a silver halide photographic light-sensitive material for photo-mechanical process comprising a support having thereon at least one light-sensitive silver halide emulsion layer and at least one light-insensitive upper layer which is positioned above the light-sensitive silver halide emulsion layer, wherein at least one of the light-insensitive upper layers has a melting time longer than a melting time of the light-sensitive silver halide emulsion layer and the light-insensitive upper layer contains a polymer latex.

The objects can also be attained by a method of reduction treatment for a silver halide photographic light-sensitive material for photo-mechanical process comprising the steps of: exposing the silver halide photographic light-sensitive material as described above, development processing the exposed silver halide photographic light-sensitive material to form a silver image, and carrying out reduction treatment of the silver image.

DETAILED DESCRIPTION OF THE INVENTION

The light-insensitive upper layer in the present invention is a layer substantially composed of a hydrophilic colloid which is provided throughout above the light-sensitive silver halide emulsion layer. The light-insensitive upper layer may be comprised of a single layer or two or more layers in some cases.

In the present invention, at least one light-insensitive upper layer having a melting time longer than the melting time of the light-sensitive silver halide emulsion layer means that the light-insensitive upper layer is more strongly hardened that the light-sensitive silver halide emulsion layer.

As a means for evaluating the degree of hardening in the hardened layers, it is well known in this field to use degree of swelling when swelling the hardened layer with a certain solution or scratch strength represented by a weight which causes a scratch when the hardened layer is scratched with a weighed needle-like stylus. However, in order to evaluate the present invention, it is most effective to use the time required for a hardened film to melt when it is dipped in a solution kept at a certain specified temperature (melting time: MT). It is most preferred that the measurement of melting time is carried out in a 0.2N NaOH solution kept at 75° C., but the measurement is not always limited thereto.

In order to make the melting time of at least one light-insensitive upper layer longer than the melting time of the light-sensitive silver halide emulsion layer, it is sufficient to selectively make the degree of hardening of the light-insensitive upper layer higher than that of the light-sensitive silver halide emulsion layer using a selective hardening technique of the layers. In such a case, it is preferred to employ a selective hardening technique so that the melting time of at least one light-insensitive upper layer according to the above measurement is by 50 seconds or more, more preferably by 100 seconds or more, longer than the melting time of the light-sensitive silver halide emulsion layer.

In the present invention, in order to selectively harden at least one light-insensitive upper layer, it is possible to use a process which comprises reacting gelatin used as a main binder in the light-insensitive upper layer with a diffusible low molecular weight hardener to the extent of not damaging the coating property before application thereof and thereafter coating it, as described in Japanese Patent Publication No. 17112/67 (corresponding to U.S. Pat. No. 3,362,827). Further, it is possible to use a polymer having functional groups capable of causing a cross-linking reaction with gelatin through a hardener as described in U.S. Pat. No. 4,207,109.

Moreover, a polymer having functional groups capable of reacting with gelatin (hereinafter referred to as "polymeric hardener") is preferably employed to attain the objects of the present invention since it is diffusion resistant due to its high molecular weight. Such polymeric hardeners are well known in the art and examples thereof are described in Japanese Patent Application (OPI) No. 66841/81, British Pat. No. 1,322,971, U.S. Pat. No. 3,671,256, D. M. Burness, J. Pouradier, *The Theory of the Photographic Process*, 4th Ed., page 84 (T. H. James ed.), Macmillan, New York (1977), and G. A. Campbell, L. R. Hamilton and I. S. Ponticello, *Polymeric Amine and Ammonium Salts* (E. J. Goethals ed.), pp. 321–332, Pergamon Press, New York (1979), etc.

Of the polymeric hardeners, those represented by the general formulae (I), (II) and (III) described below are preferred. Particularly, those represented by the general formula (I) are preferred.

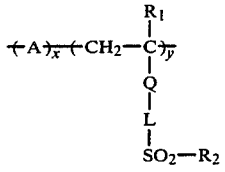

(I)

wherein A represents an ethylenically unsaturated monomer unit copolymerizable with a monomer unit set forth on the right side; $R_1$ represents a hydrogen atom or a lower alkyl group having from 1 to 6 carbon atoms; Q represents

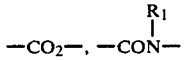

(wherein $R_1$ has the same meaning as defined above) or an arylene group having from 6 to 10 carbon atoms; L represents a divalent group having from 3 to 15 carbon atoms and containing at least one linking group selected from the members consisting of

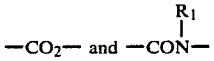

(wherein $R_1$ has the same meaning as defined above) or a divalent group having from 1 to 12 carbon atoms and containing at least one linking group selected from the members consisting of

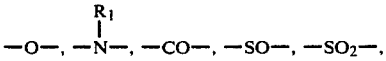

-continued $$-SO_3-,\ -SO_2\overset{R_1}{\overset{|}{N}}-,\ -\overset{R_1}{\overset{|}{N}}C\overset{R_1}{\overset{|}{O}}N-\ \text{and}\ -\overset{R_1}{\overset{|}{N}}CO_2-$$

(wherein $R_1$ has the same meaning as defined above); $R_2$ represents a vinyl group or a functional precursor group thereof selected from the members consisting of $-CH{=}CH_2$ and $-CH_2CH_2X$ (wherein X represents a group capable of being substituted with a nucleophilic group or a group capable of being released in the form of HX upon a base; and x and y each represents molar percent, x being from 0 to 99% and y being from 1 to 100%.

Examples of ethylenically unsaturated monomers represented by A of the general formula (I) include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, a monoethylenically unsaturated ester of an aliphatic acid (e.g., vinyl acetate and allyl acetate, etc.), an ethylenically unsaturated monocarboxylic or dicarboxylic acid and a salt thereof (e.g., acrylic acid, methacrylic acid, itaconic acid, maleic acid, sodium acrylate, potassium acrylate and sodium methacrylate, etc.), maleic anhydride, an ester of an ethylenically unsaturated monocarboxylic or dicarboxylic acid (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N-diethyl-N-methyl-N-methacryloyloxyethylammonium-p-toluene sulfonate, dimethyl itaconate and monobenzyl maleate, etc.), an amide of an ethylenically unsaturated monocarboxylic or dicarboxylic acid (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium-2-acrylamido-2-methylpropane sulfonate, acryloyl morpholine, methacrylamide, N,N-dimethyl-N'-acryloyl propane diamine propionate betaine, and N,N-dimethyl-N'-methacryloyl propane diamine acetate betaine, etc.). Preferred examples of ethylenically unsaturated monomers represented by A of the general formula (I) include water soluble monomers, for example sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, sodium acrylate, N,N,N-triethyl-N-methacryloyloxyethylammonium-p-toluene sulfonate, N,N-diethyl-N-methyl-N-methacryloyloxyethylammonium-p-toluene sulfonate, acrylamide, N,N,N-trimethyl-N-(N-acryloylpropyl)ammonium-p-toluene sulfonate, sodium 2-acrylamido-2-methylpropane sulfonate, N,N-dimethyl-N'-acryloyl propane diamine propionate betaine, N,N-dimethyl-N'-methacryloyl propane diamine acetate betaine etc. Particularly preferred examples of ethylenically unsaturated monomers represented by A of the general formula (I) include water soluble anionic monomers and water soluble amphoteric monomers, for example sodium vinylbenzenesulfonate, sodium vinylbenzylsulfonate, sodium acrylate, sodium 2-acrylamido-2-methylpropane sulfonate, N,N-dimethyl-N'-acryloyl propane diamine propionate betaine, N,N-dimethyl-N'-methacryloyl propane diamine acetate betaine etc. and acrylamide.

Further, when the polymer according to the present invention is used as a cross-linked latex, "A" includes not only the ethylenically unsaturated monomers described above but also monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate and neopentyl glycol dimethacrylate, etc.).

Examples of $R_1$ of the general formula (I) include a methyl group, an ethyl group, a butyl group and an n-hexyl group.

Examples of Q of the general formula (I) include the following groups:

$$-CO_2-,\ -CONH-,\ -\overset{CH_3}{\overset{|}{C}}ON-,\ -\overset{C_2H_5}{\overset{|}{C}}ON-,\ -\overset{n\text{-}C_4H_9}{\overset{|}{C}}ON-,$$

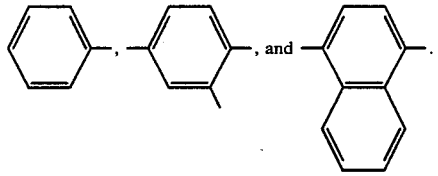

Examples of L of the general formula (I) include the following groups:

$$-CH_2CO_2CH_2-,\ -CH_2CO_2CH_2CH_2-,$$
$$-CH_2CH_2CO_2CH_2CH_2-,\ -(CH_2)_5CO_2CH_2CH_2-,$$
$$-(CH_2)_{10}CO_2CH_2CH_2-,\ -CH_2NHCOCH_2-,$$
$$-CH_2NHCOCH_2CH_2-,\ -(CH_2)_5NHCOCH_2CH_2-,$$
$$-(CH_2)_5NHCOCH_2CH_2-,\ -(CH_2)_{10}NHCOCH_2CH_2-,$$

$$-CH_2OCH_2-,\ -CH_2CH_2OCH_2CH_2CH_2-,\ -\overset{CH_3}{\overset{|}{N}}CH_2CH_2-,$$

$$-CH_2\overset{CH_3}{\overset{|}{N}}CH_2CH_2-,\ -COCH_2CH_2-,\ -CH_2COCH_2CH_2-,$$

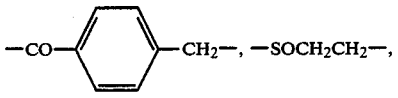

$$-CH_2SOCH_2CH_2-,\ -SO_2CH_2CH_2-,$$

$$-SO_2CH_2CH_2SO_2CH_2CH_2-,\ -SO_2CH_2CH_2SO_2CH_2\underset{\underset{OH}{|}}{C}HCH_2-,$$

$$-SO_3CH_2CH_2CH_2-,\ -SO_3CH_2CO_2CH_2CH_2-,$$
$$-SO_3CH_2CH_2CO_2CH_2CH_2-,\ -SO_2NHCH_2CO_2CH_2CH_2-,$$
$$-SO_2NHCH_2CH_2CO_2CH_2CH_2-,\ -NHCONHCH_2CH_2-,$$
$$-CH_2NHCONHCH_2CH_2-,\ -NHCO_2CH_2CH_2-\ \text{and}$$
$$-CH_2NHCO_2CH_2CH_2-.$$

Examples of $R_2$ of the general formula (I) include the following groups:

$$-CH{=}CH_2,\ -CH_2CH_2Cl,\ -CH_2CH_2Br,\ -CH_2CH_2O_3SCH_3,$$

-continued

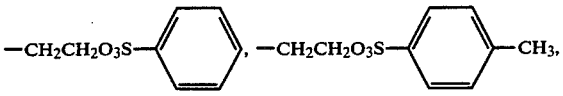

$-CH_2CH_2OH$, $-CH_2CH_2O_2CCH_3$, $-CH_2CH_2O_2CCF_3$ and $-CH_2CH_2O_2CCHCl_2$.

Other preferred examples of the polymeric hardeners are described in U.S. Pat. No. 4,161,407 (incorporated herein by reference to disclose such hardness), which have a repeating unit represented by the following general formula (II):

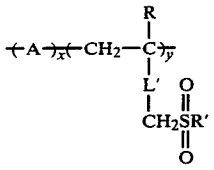

(II)

wherein A represents an ethylenically unsaturated monomer unit copolymerizable with a monomer unit set forth on the right side and A may contain one or more kind(s) of ethylenically unsaturated monomer unit; x and y each represents molar percent, x being from 10 to 95% and y being from 5 to 90%; R represents a hydrogen atom or an alkyl group having from 1 to 6 carbon atoms; R' represents $-CH=CH_2$ or $-CH_2CH_2X$ (wherein X represents a group capable of being substituted with a nucleophilic group or a group capable of being released in the form of HX upon a base); and L' represents a linking group selected from the members consisting of an alkylene group (preferably an alkylene group having from 1 to 6 carbon atoms, such as a methylene group, an ethylene group, an isobutylene group, etc.), an arylene group having from 6 to 12 carbon atoms (such as a phenylene group, a tolylene group, a naphthalene group, etc.), —COZ— or $-COZR_3-$ (wherein $R_3$ represents an alkylene group having from 1 to 6 carbon atoms or an arylene group having from 6 to 12 carbon atoms and Z represents an oxygen atom or NH).

Examples of A of the general formula (II) include the same examples of A of the general formula (I), examples of R of the general formula (II) include the same examples of $R_1$ of the general fromula (I) and examples of R' of the general formula (II) include the same examples of $R_2$ of the general formula (I), all of which are described above.

Still other preferred examples of the polymeric hardeners are described in British Pat. No. 1,534,455, which have a repreating unit represented by the following general formula (III):

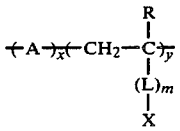

(III)

wherein A represents an ethylenically unsaturated monomer unit copolymerizable with a monomer unit set forth on the right side; R represents a hydrogen atom or an alkyl group having from 1 to 6 carbon atoms; L represents a divalent linking group having from 1 to 20 carbon atoms (preferably a divalent group having from 1 to 12 carbon atoms and containing at least one linking group selected from the members consisting of —CONH— and —CO—); X represents an active ester group; x and y each represents molar percent, x being from 0 to 95% and y being from 5 to 100; and m represents 0 or 1.

Examples of A of the general formula (III) include the same examples of A of the general formula (I) and examples of R of the general formula (III) include the same examples of $R_1$ of the general formula (I), both of which are described above.

Examples of L of the general formula (III) include the following groups: $-CONHCH_2-$, $-CONHCH_2CH_2-$, $-CONHCH_2CH_2CH_2-$, $-CONHCH_2CH_2CH_2CH_2CH_2-$, $-COCH_2CH_2OCOCH_2CH_2-$, $-CONHCH_2CONHCH_2-$, $-CONHCH_2CONHCH_2CONHCH_2-$, $-COCH_2-$, $-CONHCH_2NHCOCH_2CH_2SCH_2CH_2-$ and $-CONHCH_2OCOCH_2CH_2-$.

Examples of X of the general formula (III) include the following groups:

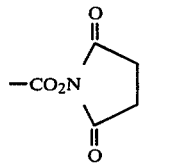

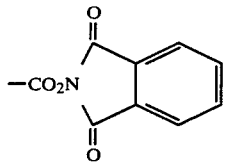

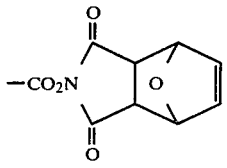

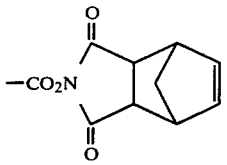

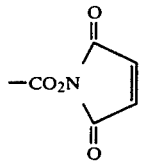

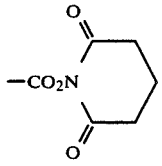

-continued

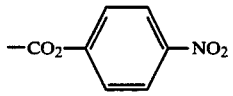

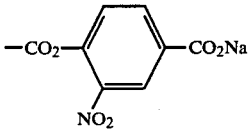

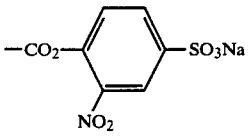

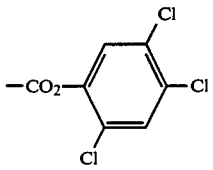

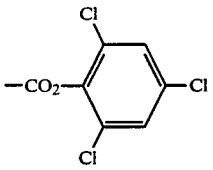

-continued

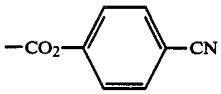

$-CO_2CH_2CN$
$-CO_2CH_2CO_2C_2H_5$
$-CO_2CH_2CONH_2$
$-CO_2CH_2COCH_3$

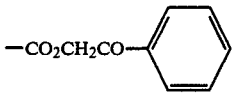

$-CO_2CH_2CO_2CH{=}CH_2$
$-CO_2N{=}CHCH_3$
$-CO_2N{=}C(CH_3)_2$ $-CO_2C(CH_3){=}CHCOCH_3$

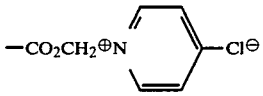

$-CO_2CH_2CH_2Br$
$-CO_2CH_2CH_2CN$ $-CO_2CH_2CH_2\overset{\oplus}{N}(CH_3)_2-CH_3Cl^{\ominus}$ Specific examples of the compounds which can be used in the present invention are set forth below, but the present invention is not to be construed as being limited thereto.

P-1 $\leftarrow CH_2CH(CONHC(CH_3)_2CH_2SO_3Na)\rightarrow_x$ $\leftarrow CH_2CH(COOCH_2CH_2OCOCH_2SO_2CH{=}CH_2)\rightarrow_y$ x/y = 3/1

P-2 $\leftarrow CH_2CH(CONHC(CH_3)_2CH_2SO_3Na)\rightarrow_x$ $\leftarrow CH_2CH(CONHCH_2NHCOCH_2CH_2SO_2CH{=}CH_2)\rightarrow_y$ x/y = 3/1

P-3 $\leftarrow CH_2CH(CONHC(CH_3)_2CH_2SO_3Na)\rightarrow_x$ $-CH_2CH(CONHCH_2CH_2CH_2NHCOCH_2CH_2SO_2CH{=}CH_2)\rightarrow_y$ x/y = 3/1

P-4 $\leftarrow CH_2CH(CONHC(CH_3)_2CH_2SO_3Na)\rightarrow_x$ $\leftarrow CH_2CH\rightarrow_y$ x/y = 3/1

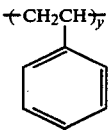

$SO_2CH_2CH_2SO_2CH{=}CH_2$

P-6 $\leftarrow CH_2CH(CONHC(CH_3)_2CH_2SO_3Na)\rightarrow_x$ $\leftarrow CH_2CH(COOCH_2CH_2OCOCH_2SO_2CH_2CH_2Cl)\rightarrow_y$ x/y = 3/1

P-7 $\leftarrow CH_2CH\rightarrow_x$ $\leftarrow CH_2CH(CONHCOCH_2CH_2SO_2CH_2CH_2Cl)\rightarrow_y$ x/y = 3/1

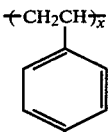

$SO_3K$

-continued

P-8 $\left(CH_2CH\right)_x$ COOM — $\left(CH_2CH\right)_y$ $CONHCH_2COCH_2CH_2SO_2CH_2CH_2Cl$ x/y = 10/1

P-9 $\left(CH_2CH\right)_x$ COOM — $\left(CH_2CH\right)_y$ $CONHCH_2NHCOCH_2CH_2SO_2CH{=}CH_2$ x/y = 10/1

P-10 $\left(CH_2CH\right)_x$ $COO(CH_2)_3SO_3Na$ — $\left(CH_2CH\right)_y$ CONH— 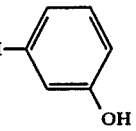 x/y = 3/1

P-11 $\left(CH_2CH\right)_x$ $CONH_2$ — $\left(CH_2CH\right)_y$ 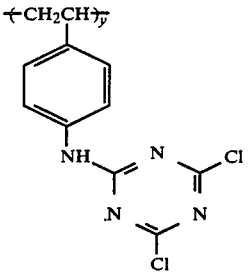 x/y = 20/1

P-12 $\left(CH_2CH\right)_x$ $CONHC(CH_3)_2CH_2{-}SO_2Na$ — $\left(CH_2CH\right)_y$ $COOCH_2CH_2N(CH_3)$ 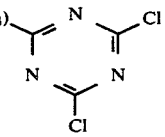 x/y = 5/1

P-13 $\left(CH_2CH\right)_x$ 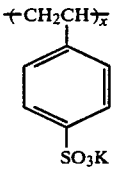 $SO_3K$ — $\left(CH_2CH\right)_y$ 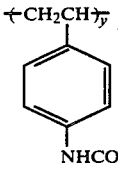 $NHCONHCOCH_2CH_2Cl$ x/y = 10/1

P-14 $\left(CH_2CH\right)_x$ COONa — $\left(CH_2{-}C(CH_3)\right)_y$ $COOCH_2CH_2NHCONHCOCH_2CH_2Cl$ x/y = 5/1

P-15 $\left(CH_2CH\right)_x$ $CONHC(CH_3)_2CH_2SO_3Na$ — $\left(CH_2{-}C(CH_3)\right)_y$ $CONH(CH_2)_3NHCONHCOCH_2CH_2Cl$ x/y = 10/1

In the above formulae, M represents a hydrogen atom, a sodium atom or a potassium atom, and x and y each represents a molar percent of the corresponding unit charged, which are not limited to the above-described values, and x may have a value of 0 to 99 and y may have a value of 1 to 100.

Preferred examples of the compounds which can be used in the present invention include compounds having a vinyl sulfone group and the precursor thereof as a functional group capable of reacting with gelatin, for example P-1, P-2, P-3, P-4, P-6, P-7, P-8, P-9, etc. Particularly preferred example of the compound includes P-2.

The molecular weight of compounds which can be used in the present invention is at least about 10,000, and it is preferably 10,000 to several hundred thousands with respect to a non-cross-linked compounds. The amount of compounds which can be used in the present invention is preferably $5\times10^{-4}$ equivalent to 0.1 equivalent, particularly preferably $2\times10^{-3}$ equivalent to $4\times10^{-2}$ equivalent per 100 g of gelatin used in the light-insensitive upper layer expressed in terms of the amount of functional group capable of reacting with gelatin. However, the amount of compounds varies corresponding to a melting time of light-insensitive upper layer.

In the following, specific examples of methods for synthesizing typical ethylenically unsaturated monomers having a vinyl sulfone group or a functional group that is a precursor thereof, which are used for synthesizing polymeric hardeners used in the present invention are described

SYNTHESIS EXAMPLE 1

Synthesis of 2-[3-(Chloroethylsulfonyl)propionyloxy]ethyl Acrylate

A mixture of 600 ml of tetrahydrofuran, 45.8 g of hydroxyethyl acrylate, and 72 g of 3-(2-chloroethylsulfonyl)propionic acid chloride was placed in a reactor, and while maintaining the temperature at 5° C. or lower by cooling by ice water, a solution containing 31.2 g of pyridine dissolved in 100 ml of tetrahydrofuran was added dropwise thereto over a period of 1.75 hours. The resulting mixture was further stirred for 2 hours at room temperature. At the end of the time, the reaction mixture was poured into 2.5 liters of ice water, and extraction was performed four times with 300 ml of chloroform. The organic layer thus-extracted was dried over sodium sulfate and concentrated to provide 87 g of 2-[3-(chloroethylsulfonyl)-propionyloxy]ethyl acrylate which was a liquid at room temperature (decomposed during distillation). Yield was 88%.

SYNTHESIS EXAMPLE 2

Synthesis of N-{[3-(chloroethylsulfonyl)propionyl]aminomethyl}acrylamide

In a 2 liter reactor was introduced 1,400 ml of distilled water, 224 g of sodium sulfite, and 220 g of sodium hydrogencarbonate, which were then stirred to form a uniform solution. Then, while maintaining the temperature at about 5° C. by cooling with ice water, 260 g of chloroethanesulfonyl chloride was added dropwise thereto over a period of 1.5 hours. After the dropwise addition was completed, 160 g of 49% sulfuric acid was added dropwise thereto over a period of about 15 minutes, and the resulting mixture was stirred for 1 hour at 5° C. Crystals precipitated were collected by filtration and washed with 400 ml of distilled water. The filtrate and the washing liquid were combined together and placed in a 3 liter reactor. Into the reactor was introduced dropwise a solution containing 246 g of methylenebisacrylamide dissolved in 480 ml of distilled water and 1,480 ml of ethanol while maintaining the temperature at about 5° C. by cooling with ice over a period of 30 minutes. The reactor was then placed in a refrigerator and was allowed to stand for 5 days to complete the reaction. Crystals precipitated were collected by filtration and, thereafter, they were washed with 800 ml of cooled distilled water and recrystallized from 2,000 ml of a 50% aqueous solution of ethanol to obtain 219 g of the desired monomer. Yield was 49%. Melting Point was 186°–187° C.

Elemental Analysis (found): H: 5.17; C: 37.90; N: 9.48; Cl: 12.58.

SYNTHESIS EXAMPLE 3

Synthesis of [3-(Chloroethylsulfonyl)propionyl]aminomethylstyrene

A mixture of 100 ml of tetrahydrofuran, 20.1 g of vinylbezylamine, 16.7 g of triethylamine, and 0.1 g of hydroquinone was placed in a reactor, and while cooling with ice water, a solution containing 36.1 g of β-chloroethylsulfonylpropionic acid chloride dissolved in 200 ml of tetrahydrofuran was added dropwise thereto over a period of 30 minutes. The resulting mixture was allowed to stand overnight at room temperature. The reaction mixture was then poured into a solution prepared by diluting 16.5 g of concentrated hydrochloric acid with 1.5 liters of ice water, and the thus formed precipitate was collected by filtration. The precipitate was recrystallized from a solvent mixture of 200 ml of ethanol and 200 ml of water to provide 26.8 g of N-vinylbenzyl-β-chloroethylsulfonyl propionic acid amide. Yield was 57%. Melting point was 107°–108° C.

Elemental analysis (found): H: 5.74; C: 53.47; N: 4.83; Cl: 10.99; S: 10.49.

SYNTHESIS EXAMPLE 4

Synthesis of 1-{[2-(4-Vinylbenzenesulfonyl)ethyl]sulfonyl}-3-chloroethylsulfonyl-2-propanol A mixture of 157 g of 1,3-bischloroethylsulfonyl-2-propanol (prepared by the method described in British Pat. No. 1,534,455), 1 liter of methanol, and 1 liter of distilled water was placed in a reactor, and while maintaining the temperature at 46° C. by heating, a solution prepared by dissolving 52 g of potassium vinylbenzensulfinate in 100 ml of methanol and 100 ml of distilled water was added dropwise thereto over a period of 1 hour. The resulting mixture was further stirred for 5.5 hours while maintaining at 46° C. The precipitate thus formed was collected by filtration to obtain 55 g of 2-(1-vinylbenzenesulfonyl)ethylsulfonyl-3-chloroethylsulfonyl-2-propanol. Yield was 49%.

Elemental Analysis (found): H: 4.67; C: 39.89; S: 21.43.

In addition, specific examples of methods of synthesizing polymeric hardeners which can be used in the present invention are described hereinafter.

SYNTHESIS EXAMPLE 5

Synthesis of 2-[3-(Vinylsulfonyl)propionyloxy]ethyl Acrylate/Sodium Acrylamido-2-methylpropanesulfonate Copolymer (P-1)

A mixture of 60 ml of N,N-dimethylformamide, 14.5 g of 2-[3-(chloroethylsulfonyl)propionyloxy]ethyl acrylate, and 23.5 g of acrylamido-2-methylpropanesulfonic acid was placed in a reactor. After purging with nitrogen gas, the mixture was heated to 60° C., and 0.40 g of 2,2'-azobis(2,4-dimethylvaleronitrile) was added thereto. The resulting mixture was stirred for 2 hours while heating at that temperature. Subsequently, 0.2 g of 2,2'-azobis-(2,4-dimethylvaleronitrile) was added, and the mixture was stirred for 2 hours while heating. At the end of the time, the mixture was cooled down to 5° C., and 12 g of sodium carbonate and 4.9 g of triethylamine were added. The resulting mixture was stirred for 1 hour and additionally for 1 hour at room temperature. The reaction mixture was placed in a tube of cellulose and was subjected to dialysis for 2 days. The product was freeze-dried to obtain 35 g of a white polymer. Yield was 95%. The vinylsulfone content of the polymer thus formed was $0.51\times10^{-3}$ equivalent/g.

SYNTHESIS EXAMPLE 6

Synthesis of N-{[3-(Vinylsulfonyl)propionyl]aminomethyl}Acrylamide/Sodium Acrylamido-2-methylpropanesulfonate Copolymer (P-2)

A mixture of 5.65 g of the monomer prepared in Synthesis Example 2, 9.16 g of sodium acrylamido-2-methylpropanesulfonate, and 80 ml of a 50% aqueous solution of ethanol was placed in a 200 ml reactor, and was heated to 80° C. while stirring. At this temperature, 0.1 g of 2,2'-azobis(2,4-dimethylvaleronitirle) (sold by Wako Pure Chemical Industries Ltd. under the trade name of V-65) was added and additionally, after 30 minutes, 0.1 g of the same compound as above was added. The mixture was heated for 1 hour while stirring. Thereafter, the reaction mixture was cooled down to about 10° C. with ice water, and a solution containing 2.5 g of triethylamine dissolved in 80 ml of ethanol was added thereto. Stirring was further continued for 1 hour. At the end of the time, the reaction mixture was poured into 1 liter of acetone while stirring, and the thus formed precipitate was collected by filtration to obtain 12.4 g of Polymer (P-2). Yield was 85%. The intrinsic viscosity, [η], was 0.227, and the vinylsulfone content was $0.95\times10^{-3}$ equivalent/g.

SYNTHESIS EXAMPLE 7

Synthesis of [3-(Chloroethylsulfonyl)propionyl]aminomethylstyrene/Sodium Acrylamido-2-methylpropanesulfonate Copolymer (P-16)

A mixture of 15.8 g of [3-(vinylsulfonyl)propionyl]aminomethylstyrene, 23.6 g of sodium acrylamido-2-methylpropanesulfonate, and 75 ml of N,N-dimethylformamide was placed in a reactor. After purging with nitrogen gas, the mixture was heated to 80° C., and 0.75 g of 2,2'-azobis(2,4-dimethylvaleronitrile) was added thereto. The resulting mixture was stirred for 3 hours while heating Then, 25 ml of N,N-dimethylformamide was added, and subsequently 6.1 g of triethylamine was added dropwise at room temperature. The resulting mixture was stirred for 1 hour at room temperature. At the end of the time, the reaction mixture was filtered. The filtrate thus obtained was poured into 800 ml of acetone, and the thus-formed precipitate was collected by filtration and dried to obtain 36.2 g of pale yellow polymer. Yield was 94%. The vinylsulfone content of the polymer thus-formed was $0.80\times10^{-3}$ equivalent/g.

SYNTHESIS EXAMPLE 8

Synthesis of 1-{[2-(4-Vinylbenzenesulfonyl)ethyl]sulfonyl}-3-vinylsulfonyl-2-propanol/Sodium Acrylate Copolymer (P-19)

A mixture of 300 ml of N,N-dimethylformamide, 40.1 g of 2-(1-vinylbenzenesulfonyl)ethylsulfonyl-3-chloroethylsulfonyl-2-propanol, and 13.0 g of acrylic acid was placed in a reactor. After purging with nitrogen gas, the mixture was heated to 70° C., and 0.53 g of 2,2'-azobis-(2,4-dimethylvaleronitrile) was added thereto. The resulting mixture was heated for 1.5 hours while stirring. Subsequently, 0.53 g of 2,2'-azobis(2,4-dimethylvaleronitrile) was added thereto, and the mixture was further heated for 1 hour while stirring. The reaction mixture was allowed to cool down to room temperature, and 54.8 g of a 28% methanol solution of sodium methylate was added dropwise thereto. Stirring was further continued for 1 hour. The reaction mixture was placed in a tube of cellulose and was subjected to dialysis for 2 days. The product was freeze-dried to obtain 30 g of pale yellow polymer. Yield was 56%. The vinylsulfone content of the polymer thus formed was $1.4\times10^{-3}$ equivalent/g.

In order to harden the light-insensitive upper layer, the polymeric hardener as described above may be used either alone or in combination with a diffusible low molecular hardener. In the latter case, the diffusible low molecular hardener can diffuse into the emulsion layer and harden the emulsion layer. Thus, the light-insensitive upper layer is hardened by both the diffusion resistant polymeric hardener and the low molecular hardener. Thus, the light-insensitive upper layer is more strongly hardened than the light-sensitive silver halide emulsion layer, thereby the selective hardening can be achieved. Examples of such diffusible low molecular hardeners include various kinds of organic and inorganic hardeners which can be used alone or in combination thereof. Typical examples of them include an aldehyde compound such as mucochloric acid, formaldehyde, trimethylolmelamine, glyoxal, 2,3-dihydroxy-1,4-dioxane, 2,3-dihydroxy-5-methyl-1,4-dioxane, succinaldehyde or glutaraldehyde, etc.; an active vinyl compound such as divinyl sulfone, methylenebismaleimide, 1,3,5-triacryloylhexahydro-s-triazine, 1,3,5-trivinylsulfonylhexahydro-s-triazine, bis(vinylsulfonylmethyl)ether, 1,3-bis(vinylsulfonyl)propanol-2, bis(α-vinylsulfonylacetamido)ethane, 1,2-bis(vinylsulfonyl)ethane or 1,1'-bis(vinylsulfonyl)methane, etc.; an active halogen compound such as 2,4-dichloro-6-hydroxy-s-triazine, etc.; and an ethyleneimine compound such as 2,4,6-triethyleneimino-s-triazine, etc., which are well known in the art as hardeners for gelatin.

Addition of the polymeric hardener is carried out by adding the hardener dissolved in water or an organic solvent, directly to the layer which is desired to control the degree of hardening. When a diffusible hardener is used together, it may be added directly to the light-insensitive upper layer to which the polymeric hardener is added, but it may be added to other light-insensitive upper layers so as to diffuse into all the layers. The amount of the diffusion resistant polymeric hardener to be added is prescribed by the amount of reactive groups present in the polymeric hardener.

Still another method for selectively controlling the degree of hardening of the layer is a method in which the diffusibility of a low molecular hardener is controlled by regulating the method of addition and drying conditions. For example, coating solutions for multilayers in which only a coating solution for a surface protective layer contains a low molecular hardener containing a vinylsulfone group are simultaneously coated and rapidly dried, whereby the degree of hardening can be controlled from layer to layer.

Thus, at least one light-insensitive upper layer can be selectively hardened in a manner that the melting time of the light-insensitive upper layer is longer than the melting time of the light-sensitive silver halide emulsion layer. Thereby, speed of oxidizing and dissolving the silver image by a reducer has different directions. That is, since at least one light-insensitive upper layer is more strongly hardened than the light-sensitive silver halide emulsion layer in which the silver image is formed, the reducer attacks the silver image from the direction of diminishing silver image area (i.e., from the horizontal direction to the light-sensitive silver halide emulsion layer) faster than from the direction of decreasing silver image density (i.e., from the perpendicular direction to the light-sensitive silver halide emulsion layer). Therefore, according to the present invention, the reduction width, i.e., the diminution in silver image area per the decrease in silver image density, can be widened.

The coating amount of the hydrophilic colloid binder in the light-insensitive upper layer according to the present invention is not particularly limited. However, the remarkable effects of the present invention can be obtained where the coating amount of the hydrophilic colloid binder in the light-insensitive upper layer is equal to that or by less than about 5 times as much as that in the light-sensitive silver halide emulsion layer. For example, when the photographic light-sensitive material has a layer structure comprising two light-sensitive silver halide emulsion layers and another light-insensitive colloid layer positioned between the light-insensitive uppermost layer and the light-sensitive silver halide emulsion layer, it is preferred that the total coating amount of the hydrophilic colloid binders present in both the uppermost layer and the colloid layer present thereunder is equal to or more than the total coating amount of the hydrophilic colloid binders present in the two light-sensitive silver halide emulsion layers.

As a hydrophilic colloid binder used in the light-insensitive upper layer in the present invention, it is advantageous to use gelatin, but other hydrophilic colloids can be used.

For example, it is possible to use a protein such as a gelatin derivative, a graft polymer of gelatin and another polymer, albumin or casein, etc.; a saccharide such as a cellulose derivative such as hydroxyethyl cellulose, carboxymethyl cellulose or cellulose sulfate, etc., sodium alginate or a starch derivative, etc.; and a hydrophilic synthetic high molecular substance such as a homo- or copolymer including polyvinyl alcohol, polyvinyl alcohol partial acetal, poly-N-vinylpyrrolidone, polyacrylic acid, polymethacrylic acid, polyacrylamide, polyvinylimidazole and polyvinyl pyrazole, etc. Examples of gelatin include not only lime-treated gelatin but also acid-treated gelatin and enzyme-treated gelatin as described in *Bull. Soc. Sci. Phot. Japan,* No. 16, page 30 (1966) may be used. Further, a hydrolyzed product and an enzymatic decomposition product of gelatin can be used.

The polymer latex which can be incorporated into the light-insensitive upper layer of the light-sensitive material for photo-mechanical process of the present invention includes a hydrate of a vinyl polymer containing a monomer unit such as an acrylic acid ester, a methacrylic acid ester, styrene, etc., as described in U.S. Pat. Nos. 2,772,166, 3,325,286, 3,411,911, 3,311,912 and 3,525,620, *Research Disclosure,* Vol. 195, No. 19551 (July, 1980), etc. A homopolymer of alkyl acrylate or alkyl methacrylate such as methyl acrylate, ethyl acrylate, butyl acrylate, methyl methacrylate, ethyl methacrylate, etc., and a copolymer of alkyl acrylate or alkyl methacrylate and vinyl monomer such as acrylic acid, N-methylolacrylamide, etc., are particularly preferred.

A preferred average particle size of the polymer latex used in the present invention is a range from 0.005$\mu$ to 1$\mu$ and particularly a range from 0.02$\mu$ to 0.1$\mu$.

By the utilization of polymer latex, the occurrence of reticulation can be prevented extremely effectively. Of the above-described polymer latexes, those having a high glass transition temperature (Tg) are preferred since they also have an ability to improve any antiadhesive property. Particularly, polymer latexes having a glass transition temperature of room temperature or higher are preferred. For example, a hydrate of a homopolymer of vinyl monomer such as methyl methacrylate, ethyl methacrylate, styrene, etc., and a copolymer of such vinyl monomer and other vinyl monomer such as acrylic acid, N-methylolacrylamide, etc., are particularly preferred. The amount of the polymer latex used is preferably from 5% to 200% and more preferably from 10% to 100%, based on the weight of hydrophilic colloid contained in the layer to be added.

The polymer latex can be added to the above-described light-insensitive upper layer having a melting time longer than the melting time of the light-sensitive silver halide emulsion layer. Also, in a case wherein the light-insensitive upper layer is composed of two or more layers, the polymer latex can be added to a light-insensitive upper layer other than the light-insensitive upper layer having a melting time longer than the melting time of the emulsion layer. For example, a structure in which a second light-insensitive upper layer is provided between an emulsion layer and a light-insensitive upper layer having a melting time longer than the melting time of the emulsion layer, and the second light-insensitive upper layer contains the polymer latex is preferred.

In the following, specific examples of the polymer latex which can be used in the present invention are set forth, but the present invention is not to be construed as being limited thereto.

L-1

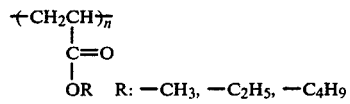

L-2

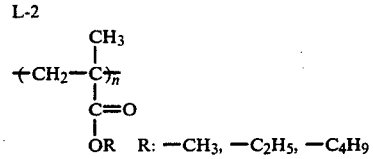

L-3

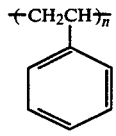

L-4

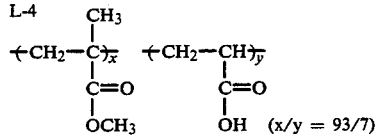

L-5

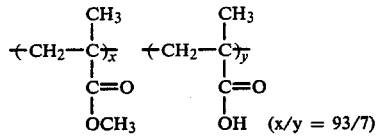

L-6

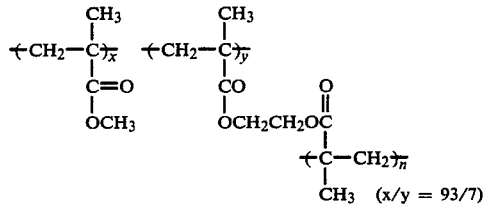

-continued

L-7

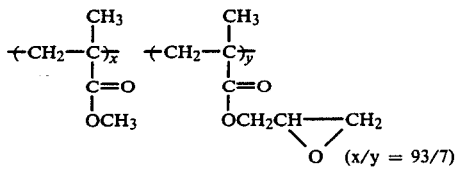

(x/y = 93/7)

L-8

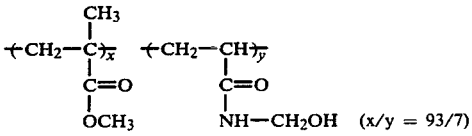

(x/y = 93/7)

L-9

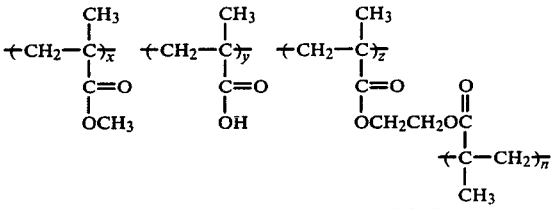

(x/y/z = 93/3/4)

L-10

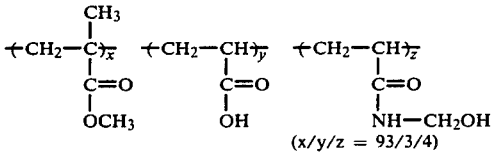

(x/y/z = 93/3/4)

L-11

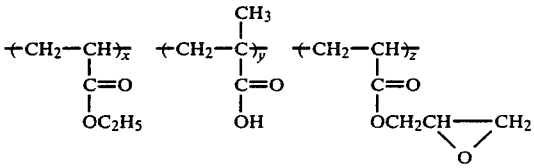

(x/y/z = 93/3/4)

Among the polymer latexes which can be used in the present invention, the molecular weights of L-1 to L-5 are 10,000 to several hundred thousands, and those of L-6 to L-11 are infinite because those polymer latexes are subjected to gelation by crosslinked.

A typical example of synthesizing the polymer latex used in the present invention is shown below.

Synthesis Example of Polymer Latex of Methyl Methacrylate

In a 1,000 ml 3-neck flask equipped with a gas inlet conduit, a reflux condenser and a stirrer, 150.0 g of methyl methacrylate was emulsified dispersed in a solution containing 4.28 g of sodium laurylsulfate dissolved in 800 ml of distilled water and to the resulting dispersion was added 9.6 mg of ferrous chloride. To 20 ml of distilled water, 0.41 g of potassium persulfate and then 0.16 g of sodium hydrogen sulfite were dissolved and was added 2.0 ml of 2N aqueous ammonia to prepare a polymerization initiator. The polymerization initiator was added to the above-described mixture while maintaining the temperature in the flask at 60° C. After 2 hours, the same polymerization initiator as described above was added to the reaction mixture and subjected to post polymerization for 2 hours. After cooling the reaction mixture was filtered using a thin filter paper to obtain a polymer latex of methyl methacrylate of protein color which has 15.9% by weight of concentration, 0.04μ of particle size and 6.13 of pH.

Other polymer latexes described above can also be synthesized generally with reference to the synthesis example above.

The light-insensitive upper layer in the present invention may contain a surface active agent, an antistatic agent, a matting agent, a lubricant, colloidal silica, a plasticizer for gelatin, etc., in addition to the above-described hydrophilic colloid binder (for example, gelatin) and polymer latex.

Examples of useful matting agents include particles of polymethyl methacrylate or silicon dioxide having an average particle size of 0.1μ to 10μ and preferably 1μ to 5μ.

It is preferred that the light-insensitive upper layer is coated at a total dry thickness of from 0.3μ to 5μ and particularly from 0.5μ to 3μ.

As described hereinbefore, the term "light-sensitive materials for photo-mechanical process" used in the present invention means light-sensitive materials employed when printing dot images or line drawing images by photographic photo-mechanical process in the field of printing industry. Although the species and properties of them are not especially limited, the most general light-sensitive materials are light-sensitive materials having hard tone such as so-called lithographic films.

There is no restriction with respect to the type of silver halide used in the light-sensitive silver halide emulsion layer in the light-sensitive material for photo-mechanical process of the present invention. Silver halide such as silver chlorobromide, silver chloroiodobromide, silver iodobromide and silver bromide can be used. However, it is particularly preferred to use silver chlorobromide or silver chloroiodobromide containing at least 60% by mol (preferably 75% by mol or more) of silver chloride and 0 to 5% by mol of silver iodide. Form, crystal habit and distribution of size of the silver halide particles are not especially limited, but it is preferred to have a particle size of 0.7μ or less.

The sensitivity of the silver halide emulsion can be increased without increasing the particle size of silver halide by using a gold compound such as chloroaurate or gold trichloride, a salt of noble metal such as rhodium or iridium, a sulfur compound capable of forming silver sulfide by reacting with a silver salt, or a reducing substance such as a stannous salt or an amine.

Further, it is possible to add a salt of noble metal such as rhodium or iridium, or an iron compound such as ferricyanide at the time of nucleus forming or physical ripening of silver halide particles.

The photographic emulsion used in the present invention may be subjected to spectral sensitization using a methine dye, etc. These sensitizing dyes may be used individually or as a combination thereof. A combination of sensitizing dyes is often employed particularly for the purpose of supersensitization. The sensitizing dyes may be present in the emulsion together with dyes which themselves have no spectrally sensitizing effects but exhibit a supersensitizing effect or materials which do not substantially absorb visible light but exhibit a supersensitizing effect. Examples of the useful sensitizing dyes, the combinations of dyes exhibiting the supersensitizing effect and the materials exhibiting the supersensitizing effect are described in *Research Disclosure,* Vol. 176, No. 17643, page 23, IV-J (December, 1978).

In the photographic emulsion, it is possible to use any known anti-fogging agents as described, for example, in Japanese Patent Application (OPI) Nos. 81024/74, 6306/75 and 19429/75, U.S. Pat. No. 3,850,639 such as numbers of heterocyclic compounds including 4-hydroxy-6-methyl-1,3,3a,7-tetraazaindene, 3-methylbenzothiazole or 1-phenyl-5-mercaptotetrazole, etc., mercury containing compounds, mercapto compounds, etc.

A surface active agent may be added to the light-sensitive silver halide emulsion layer in the present invention as a coating aid or for the purpose of improving photographic properties.

Examples of useful surface active agents include a natural surface active agent such as saponin, a nonionic surface active agent such as alkylene oxide type, glycidol type, etc.; an anionic surface active agent containing an acid group such as a carboxylic acid, a sulfonic acid (for example, surface active agents as described in U.S. Pat. No. 3,415,649), a phosphoric acid, a sulfuric acid ester, a phosphoric acid ester group, etc.; and an ampholytic surface active agent such as an amino acid, an aminosulfonic acid, or a sulfuric acid or phosphoric acid ester of aminoalcohol, etc.

Polyalkylene oxide compounds which can be used in the present invention incldue alkylene oxide having from 2 to 4 carbon atoms, for example, ethylene oxide, propylene-1,2-oxide, butylene-1,2-oxide, etc.; condensation products of polyalkylene oxide composed of at least 10 alkylene oxide units, preferably ethylene oxide units and a compound having at least one active hydrogen atom such as water, an aliphatic alcohol, an aromatic alcohol, a fatty acid, an organic amine or a hexitol derivative; and block copolymers of two or more polyalkylene oxides. Namely, examples of the polyalkylene oxide compounds used include polyalkylene glycols, polyalkylene glycol alkyl ethers, polyalkylene glycol aryl ethers, polyalkylene glycol alkylaryl esters, polyalkylene glycol esters, polyalkylene glycol fatty acid amides, polyalkylene glycol amines, polyalkylene glycol block copolymers and polyalkylene glycol graft polymers, etc.

Specific examples of the polyalkylene oxide compounds preferably used in the present invention include the following compounds.

1. $HO(CH_2CH_2O)_9H$
2. $C_{12}H_{25}O(CH_2CH_2O)_{15}H$
3. $C_8H_{17}CH{=}CHC_8H_{16}O(CH_2CH_2O)_{15}H$

4. 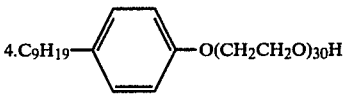

5. $C_{11}H_{23}COO(CH_2CH_2O)_{80}H$
6. $C_{11}H_{23}CONH(CH_2CH_2O)_{15}H$

7. $C_{12}H_{25}N\begin{matrix}(CH_2CH_2O)_{15}H\\(CH_2CH_2O)_{15}H\end{matrix}$

8. $C_{14}H_{29}N(CH_3)(CH_2CH_2O)_{24}H$

-continued

9. $H(CH_2CH_2O)_a(\underset{\underset{CH_3}{|}}{CHCH_2O})_b(CH_2CH_2O)_cH$ $a + b + c = 50$ b: $a + c = 10{:}9$ It is possible to add a polymer latex composed of a homo- or copolymer of alkyl acrylate, alkyl methacrylate, acrylic acid or cresidyl acrylate, etc., as described in U.S. Pat. Nos. 3,411,911, 3,411,912, 3,142,568, 3,325,286 and 3,547,650 and Japanese Patent Publication No. 5331/70, etc., to the light-sensitive silver halide emulsion layer in order to improve dimensional stability of the photographic material or improve film properties thereof.

As a hydrophilic colloid binder used in the light-sensitive silver halide emulsion layer in the present invention, it is advantageous to use gelatin, but other hydrophilic colloids can be used.

For example, it is possible to use a protein such as a gelatin derivative, a graft polymer of gelatin and another polymer, albumin or casein, etc.; a saccharide such as a cellulose derivative such as hydroxyethyl cellulose, carboxymethyl cellulose or cellulose sulfate, etc., sodium alginate or a starch derivative, etc.; and a hydrophilic synthetic high molecular substance such as a homo- or copolymer including polyvinyl alcohol, polyvinyl alcohol partial acetal, poly-N-vinylpyrrolidone, polyacrylic acid, polymethacrylic acid, polyacrylamide, polyvinylimidazole and polyvinyl pyrazole, etc. Examples of gelatin include not only lime-treated gelatin but also acid-treated gelatin and enzyme-treated gelatin as described in *Bull. Soc. Sci. Phot. Japan,* No. 16, page 30 (1966) may be used. Further, a hydrolyzed product and an enzymatic decomposition product of gelatin can be used.

It is preferred that the ratio by weight of the hydrophilic colloid binder to silver halide in the light-sensitive silver halide emulsion layer in the present invention is ½ or less.

In the present invention, the light-sensitive silver halide emulsion layer is not always composed of one layer but it may be composed of two or more layers. For example, when the light-sensitive silver halide emulsion layer is composed of two layers, it is preferred that the ratio of the total amount of silver halide in the two layers to the hydrophilic colloid binder is ½ or less and that the upper light-sensitive emulsion layer contains a larger amount of hydrophilic colloid binder than the lower light-sensitive emulsion layer.

Further, the amount of silver halide to be coated is from 1.0 to 6.0 g and, preferably, from 1.3 to 4.0 g calculated as silver per square meter. Particularly excellent effects can be obtained when a small amount of silver is coated.

In order to harden the light-sensitive silver halide emulsion layer, it is preferred to use a low molecular hardener as described hereinbefore. However, the above-described polymeric hardener or a combination of the above-described polymeric hardener and a low molecular hardener may be used, if desired.

Examples of preferred supports for the plate making light-sensitive material of the present invention include a polyester film such as a polyethylene terephthalate film and a cellulose ester film such as a cellulose triacetate film.

In the present invention, the exposure for obtaining a photographic image may be carried out in a conventional manner. Any various known light sources including natural light (sunlight), a tungsten lamp, a fluorescent lamp, a mercury lamp, a xenon arc lamp, a carbon arc lamp, a xenon flash lamp, a cathode-ray tube flying spot and so on can be employed for the exposure. Suitable exposure times which can be used include not only exposure times commonly used in cameras ranging from 1/1,000 second to 1 second, but also exposure times shorter than 1/1,000 second, for example, about $1/10^4$ to about $1/10^6$ second as used with a xenon flash lamp and a cathode-ray tube. Exposure times longer than 1 second can also be used. The spectral distribution of the light employed for the exposure can be controlled using a color filter, if desired. Laser beam can also be employed for the exposure.

The present invention does not put any particular restriction on the development processing of the plate making light-sensitive material. In general, any developing processes applied to conventional photographic material for a photomechanical process can be adopted in the development processing. Suitable processing temperature used generally ranges from 18° C. to 50° C. However, processing temperature lower than 18° C. or higher than 50° C. may be employed.

The developing solution can contain any known developing agents. Examples of developing agents which can be used alone or in mixtures include a dihydroxybenzene (e.g., hydroquinone, etc.), a 3-pyrazolidone (e.g., 1-phenyl-3-pyrazolidone, etc.), an aminophenol (e.g., N-methyl-p-aminophenol, etc.), a 1-phenyl-3-pyrazoline, an ascorbic acid, a heterocyclic compound of the kind which are obtained by condensating a 1,2,3,4-tetrahydroquinoline ring and an indolene ring as described in U.S. Pat. No. 4,067,872. In addition to such a developing agent as described above, the developing solution can contain a known preservative, an alkali agent, a pH buffer, an antifoggant and the like. Further, it may optionally contain a dissolving aid, a color toning agent, a development accelerator, a surface active agent, an antifoaming agent, a water softener, a hardener, a viscosity imparting agent and the like.

The developing solution which can be employed to great advantage in the present invention is a so-called lith type developer. The lith type developer is basically comprised of an ortho- or a para-dihydroxybenzene, an alkali agent, a small amount of free fulfite and a sulfite ion buffer, etc. The ortho- or the para-dihydroxybenzene used as the developing agent can be appropriately selected from those well known in the photographic art. Specific examples of these compounds include hydroquinone, chlorohydroquinone, bromohydroquinone, isopropylhydroquinone, toluhydroquinone, methylhydroquinone, 2,3-dichlorohydroquinone, 2,5-dimethylhydroquinone and the like. Among these hydroquinones, hydroquinone is particularly suitable for practical use. These developing agents may be employed independently or in combination. A suitable amount of the developing agent to be added ranges from 1 to 100 g, more preferably 5 to 80 g, per liter of the developing solution.

A sulfite ion buffer is employed in the developing solution in an amount such that a sulfite ion concentration therein is effectively maintained approximately constant. Suitable examples of such buffers include an adduct of aldehyde and alkali metal hydrogensulfite such as formalin-sodium hydrogensulfite adduct, an adduct of ketone and alkali metal hydrogensulfite such as acetone-sodium hydrogensulfite adduct, a condensation product of carbonyl bisulfite and amine such as sodium bis(2-hydroxy-ethyl)aminómethane sulfonate, etc. The sulfite ion buffer is generally added in an amount of 13 g of 130 g per liter of the developing solution.

In general, the concentration of free sulfite ions is controlled by the addition to the developing solution of an alkali metal sulfite such as sodium sulfite and the like. The amount of the sulfite added is generally 5 g or less, and particularly 3 g or less, per liter of the developing solution. Of course, the sulfite may be added in an amount of larger than 5 g.

In many cases, it is desirable to further add an alkali metal halide (especially a bromide such as sodium bromide, potassium bromide or the like) as a development-controlling agent. A suitable amount of the alkali metal halide to be added ranges preferably from 0.01 g to 10 g, most preferably 0.1 g to 5 g, per liter of the developing solution.

An alkali is added to adjust the developing solution to a pH of 9.0 or more (particularly to a pH of 9.7 to 11.5). Examples of alkalis generally used in the developing solution include sodium carbonate and potassium carbonate, and such a carbonate is used in greatly differing amounts.

The fixation can be carried out using a fixing solution having a conventionally used composition.

Examples of fixing agents which can be used include a thiosulfate, a thiocyanate and, further, an organic sulfur compound which is known to have effects as a fixing agent.

In the fixing solution, a water-soluble aluminum salt may be incorporated as a hardener.

In the case of dye image formation, conventional methods can be used.

Development processing may be performed by hand labor, or by using an automatic developing machine. In the case of automatic development processing, there are no restrictions as to the conveying means (e.g., a roller conveyer, a belt conveyer, etc.), and conveyance type automatic developing machines which have been used in the art can be employed. For further details of the compositions of processing solutions and the developing processes, descriptions in U.S. Pat. Nos. 3,025,779, 3,078,024, 3,122,086, 3,149,551, 3,156,173, 3,224,356 and 3,573,914, etc., can be referred to.

Furthermore, for details of the silver halide emulsion layer, other layers and the support for the light-sensitive material for photo-mechanical process of the present invention and for details of the processing method to be adopted in the present invention, descriptions in *Research Disclosure,* Vol. 176, pp. 22–28 (December, 1978) can be referred to.

There are no particular restrictions with respect to the reducer used in the present invention. For example, those described in C. E. K. Mees, *The Theory of the Photographic Process* can be effectively employed. Specifically, a reducer which contains as a reducing component a permanganate, a persulfate, a ferric salt, a cupric salt, a ceric salt, a ferricyanide, a dichromate and the like independently or in combination and optionally, an inorganic acid such as sulfuric acid, and an alcohol; or a reducer which contains a reducing component such as a ferricyanide, ethylenediaminetetraacetatoferrate (III) or the like, and a silver halide solvent such as a thiosulfate, a thiocyanate, thiourea or a derivative thereof and, optionally, an inorganic acid such as sulfuric acid, can be employed.

To the reducer to be employed in the present invention, a compound having a mercapto group, such as those described in Japanese Patent Application (OPI) No. 68419/77 may be further added, if desired.

As for the composition of the reducer used in the reduction processing of the present invention and the processing conditions (temperature, time, etc.) therein, there are no particular limitations. These conditions can be appropriately selected by one skilled in the art.

For details of the reducers and the reduction processing which can be employed, descriptions in Japanese Patent Application (OPI) Nos. 140733/76, 6841/77, 14901/78, 119236/79, 119237/79, 2245/80, 2244/80, 17123/80, 79444/80 and 81344/80, etc., can be referred to.

In the following, the present invention is illustrated in greater detail with reference to examples. However, the present invention is not to be construed as being limited to them, and various embodiments can be adopted.

EXAMPLE 1

A silver halide emulsion comprising 80% by mol of silver chloride, 19.5% by mol of silver bromide and 0.5% by mol of silver iodide was prepared by carrying out gold sensitization and sulfur sensitization in a conventional manner. Gelatin contained in this emulsion was 45% by weight based on silver halide. 3-Carboxymethyl-5-[2-(3-ethylthiazolinylidene)ethylidene]rhodanine (spectral sensitizer), 4-hydroxy-1,3,3a,7-tetraazaindene (stabilizer), polyoxyethylene nonylphenyl ether containing 50 ethylene oxide groups and a polymer latex described in Synthesis Example 3 in Japanese Patent Publication No. 5331/70 were added in order to the emulsion.

On the other hand, Polymer Latexes L-1 and L-10 were added to an aqueous gelatin solution for the light-insensitive upper layer as shown in Table 1 below respectively. 1,2-Bis(vinylsulfonylacetamido)ethane (H-1) was added in an amount as shown in Table 1 below to the above described silver halide emulsion, and Compound P-2 was added in an amount as shown in Table 1 below to the above described gelatin solution for the light-insensitive upper layer. Then, the emulsion and the gelatin solution were applied using a simultaneous multilayer coating method to a polyethylene terephthalate film base to prepare Samples 1 to 8 as shown in Table 1 below. The amount of silver coated was 3.0 g/m$^2$ and the amount of gelatin coated in the light-insensitive upper layer was 1.0 g/m$^2$. The melting time of the emulsion layer and that of the light-insensitive upper layer of these samples measured by the above described method are shown in Table 1.

TABLE 1

| Sample No. | Amount of H-1 (addition to emulsion layer) (g/m$^2$) | Amount of Compound P-2 (addition to light-insensitive upper layer) (g/m$^2$) | Polymer Latex: Compound | Polymer Latex: Amount (addition to light-insensitive layer) (g/m$^2$) | Melting Time (0.2 N NaOH, 75° C.): Emulsion Layer (sec) | Melting Time (0.2 N NaOH, 75° C.): Light-Insensitive Upper Layer (sec) | Remarks |
|---|---|---|---|---|---|---|---|
| 1 | 0.05 | None | — | None | 730 | 730 | Comparison |
| 2 | 0.20 | None | — | None | 1,720 | 1,720 | Comparison |
| 3 | 0.05 | 0.29 | — | None | 770 | 1,690 | Comparison |
| 4 | 0.05 | 0.08 | — | None | 750 | 1,200 | Comparison |
| 5 | 0.05 | 0.29 | L-1 | 0.4 | 780 | 1,700 | Present Invention |
| 6 | 0.05 | 0.08 | L-1 | 0.2 | 760 | 1,160 | Present Invention |
| 7 | 0.05 | 0.29 | L-10 | 0.4 | 790 | 1,650 | Present Invention |
| 8 | 0.05 | 0.08 | L-10 | 0.2 | 770 | 1,210 | Present Invention |

H-1: 1,2-Bis(vinylsulfonylacetamido)ethane

L-1: $-(CH_2CH(COOC_2H_5))_n-$ (Tg = −20° C.)

L-10: $-(CH_2C(CH_3)(COOCH_3))_x-(CH_2CH(COOH))_y-(CH_2CH(CONHCH_2OH))_z-$ x/y/z = 93/3/4 (Tg = 105° C.)

Dot images were then formed on the above-described samples by the following method.

A commercially available gray contact screen for negative (150 lines/inch) was placed in contact with each sample, and the sample was exposed to white tungsten light for 10 seconds through a step wedge having 0.1 of step difference. Each sample was subjected to high temperature rapid development at 38° C. for 20 seconds using the following developing solution, and then it was fixed, washed with water and dried in a conventional manner.

| Developing Solution: | |
|---|---|
| Sodium carbonate (monohydrate) | 11 g |
| Potassium bromide | 3 g |
| Hydroquinone | 23 g |
| 1-Phenyl-3-pyrazolidone | 0.4 g |
| Sodium sulfite | 67 g |
| Potassium hydroxide | 11 g |
| Water to make | 1 liter |

The resulting dot strips were immersed in the following cerium type reducer (20° C.), followed by washing with water.

| Reducer: | |
|---|---|
| Ceric sulfate | 25 g |
| Concentrated sulfuric acid | 30 g |
| Water to make | 1 liter |

A change of the area of dots and a change of the density of dots in the resulting dot strips were measured by a microdensitometer. The area of dots when the density of each dot became 2.5 after treating the dot strip having an area of dots of 50% with the reducer, the reduction time required for it, and the reduction width (difference between the area of dots before the reduction treatment and the area of dots after the reduction treatment) are shown in Table 2 below.

Further, after carrying out the same development processing as described above, the degree of reticulation which occured on each sample was examined using a microscope. The degree of reticulation is indicated by the following three stages A, B and C.

A: Reticulation is not observed at all when magnified to 100 times by a microscope.

B: Reticulation is slightly observed when magnified to 100 times by a microscope.

C: Reticulation is remarkably observed when magnified to 100 times by a microscope.

Furthermore, an adhesion test of Samples 1 to 8 were carried out using the adhesion testing method as described in Example 1 of Japanese Patent Application (OPI) No. 6017/76.

The results thus obtained are also shown in Table 2 below.

TABLE 2

| Sample No. | Before Reduction: Area of Dot (%) | Before Reduction: Density of Dot | After Reduction: Area of Dot (%) | After Reduction: Density of Dot | Reduction Time (sec) | Reduction Width (%) | Degree of Reticulation Occured | Anti-* adhesive Property | Remarks |
|---|---|---|---|---|---|---|---|---|---|
| 1 | 50 | more than 4.0 | 42 | 2.5 | 50 | 8 | A | A | Comparison |
| 2 | 50 | more than 4.0 | 42 | 2.5 | 100 | 8 | A | A | Comparison |
| 3 | 50 | more than 4.0 | 35 | 2.5 | 90 | 15 | C | A | Comparison |
| 4 | 50 | more than 4.0 | 37 | 2.5 | 50 | 13 | C | A | Comparison |
| 5 | 50 | more than 4.0 | 34 | 2.5 | 95 | 15 | A | B | Present Invention |
| 6 | 50 | more than 4.0 | 36 | 2.5 | 55 | 14 | A | B | Present Invention |
| 7 | 50 | more than 4.0 | 34 | 2.5 | 85 | 16 | A | A | Present Invention |
| 8 | 50 | more than 4.0 | 36 | 2.5 | 50 | 14 | A | A | Present Invention |

*The antiadhesive property is more improved in order of D < C < B < A.

It is apparent from the results shown in Table 2 that the samples according to the present invention, particularly Samples 7 and 8, exhibit the excellent properties, that is, broad reduction width, good antiadhesive property and no reticulation occurred even in the high temperature rapid processing. On the other hand, Sample 1 for comparison has a narrow reduction width due to a serious decrease in the density of dots. Also, as shown in Sample 2 for comparison, when the melting time of both the emulsion layer and the light-insensitive upper layer are increased by increasing the amount of low molecular hardener used, problems in that not only the decrease in the density of dots is insufficient, but also the rate of decrease in the area of dots is very slow occur.

In Samples 3 to 8, the hardening of layers is conducted so as to increase the melting time of the light-insensitive upper layer above that of the emulsion layer and to increase the broad reduction width without increasing the amount of silver coated. Samples 3 and 4 have the disadvantage in that reticulation occurs after high temperature rapid processing. On the contrary, in Samples 5 to 8 wherein the polymer latex is incorporated into the light-insensitive upper layer, the occurrence of reticulation is prevented. Further, Samples 7 and 8 containing the polymer latex having a high Tg demonstrate an excellent antiadhesive property in comparison with Samples 5 and 6 containing the polymer latex having a low Tg.

EXAMPLE 2

A silver halide emulsion comprising 80% by mol of silver chloride, 19.5% by mol of silver bromide and 0.5% by mol of silver iodide was prepared by carrying out gold sensitization and sulfur sensitization in a conventional manner. Gelatin contained in this emulsion was 45% by weight based on silver. 3-Carboxy-5-[2-(3-ethyl-thiazolinylidene)ethylidene]rhodanine (spectral sensitizer), 4-hydroxy-1,3,3a,7-tetraazaindene (stabilizer), polyoxyethylene nonylphenyl ether containing 50 ethylene oxide groups and a polymer latex described in Synthesis Example 3 in Japanese Patent Publication No. 5331/70 were added in order to the emulsion.

On the other hand, the polymer latex as shown in Table 3 below was added to an aqueous gelatin solution for the light-insensitive upper layer. 2,4-Dichloro-6-hydroxy-s-triazine(H-2) was added in an amount as shown in Table 3 below to the above-described silver halide emulsion, and Compound P-2 was added in an amount shown in Table 3 below to the above-described gelatin solution for the light-insensitive upper layer. Then, the emulsion and the gelatin solution were applied using a simultaneous multilayer coating method to a polyethylene terephthalate film base to prepare Samples 9 to 16 as shown in Table 3 below. The amount of silver coated was 3.0 g/m$^2$, and the amount of gelatin coated in the light-insensitive upper layer was 1.0 g/m$^2$. The melting time of the emulsion layer and that of the light-insensitive upper layer of these samples measured by the above-described method are shown in Table 3.

TABLE 3

| Sample No. | Amount of H-2 (addition to emulsion layer) (g/m²) | Amount of Compound P-2 (addition to light-insensitive upper layer) (g/m²) | Polymer Latex: Compound | Polymer Latex: Amount (addition to light-insensitive upper layer) (g/m²) | Melting Time (0.2 N NaOH, 75° C.): Emulsion Layer (sec) | Melting Time (0.2 N NaOH, 75° C.): Light-Insensitive Upper Layer (sec) | Remarks |
|---|---|---|---|---|---|---|---|
| 9 | 0.03 | None | — | None | 520 | 520 | Comparison |
| 10 | 0.12 | None | — | None | 1,010 | 1,010 | Comparison |
| 11 | 0.03 | 0.29 | — | None | 500 | 1,530 | Comparison |
| 12 | 0.03 | 0.08 | — | None | 490 | 900 | Comparison |
| 13 | 0.03 | 0.29 | L-1 | 0.3 | 520 | 1,450 | Present Invention |
| 14 | 0.03 | 0.08 | L-1 | 0.3 | 500 | 930 | Present Invention |
| 15 | 0.03 | 0.29 | L-10 | 0.4 | 530 | 1,490 | Present Invention |
| 16 | 0.03 | 0.08 | L-10 | 0.4 | 480 | 890 | Present Invention |

H-2: 2,4-Dichloro-6-hydroxy-s-triazine

L-1: $\left(CH_2CH\right)_n$ (COOEt)

(Tg = −20° C.)

L-10: $\left(CH_2C(CH_3)(COOCH_3)\right)_x \left(CH_2CH(COOH)\right)_y \left(CH_2CH(CONHCH_2OH)\right)_z$ (Tg = 105° C.)

x/y/z = 93/3/4

Using the above described samples, the reduction time, the reduction width, the degree of reticulation occurred and the antiadhesive property were measured in the same manner as described in Example 1. The results thus obtained are shown in Table 4 below.

TABLE 4

| Sample No. | Before Reduction: Area of Dot (%) | Before Reduction: Density of Dot | After Reduction: Area of Dot (%) | After Reduction: Density of Dot | Reduction Time (sec) | Reduction Width (%) | Degree of Reticulation Occurred | Anti-adhesive Property | Remarks |
|---|---|---|---|---|---|---|---|---|---|
| 9 | 50 | more than 4.0 | 42 | 2.5 | 40 | 8 | A | A | Comparison |
| 10 | 50 | more than 4.0 | 43 | 2.5 | 90 | 7 | A | A | Comparison |
| 11 | 50 | more than 4.0 | 36 | 2.5 | 85 | 14 | C | A | Comparison |
| 12 | 50 | more than 4.0 | 38 | 2.5 | 50 | 12 | C | A | Comparison |
| 13 | 50 | more than 4.0 | 35 | 2.5 | 80 | 15 | A | B | Present Invention |
| 14 | 50 | more than 4.0 | 37 | 2.5 | 50 | 13 | A | B | Present Invention |
| 15 | 50 | more than 4.0 | 35 | 2.5 | 85 | 15 | A | A | Present Invention |
| 16 | 50 | more than 4.0 | 37 | 2.5 | 45 | 13 | A | A | Present Invention |

It is apparent from the results shown in Table 4 that in Samples 13, 14, 15 and 16 wherein the polymer latex is incorporated into the light-insesnitive upper layer, the occurrence of retuculation is prevented and the broad reduction width is obtained without increasing the amount of silver coated. Further, Samples 15 and 16 whos the excellent antiadhesive property by the use of the polymer latex having a high Tg.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material for photo-mechanical process comprising a support having thereon at least one light-sensitive silver halide emulsion layer and at least one light-insensitive upper layer which is positioned above the light-sensitive silver halide emulsion layer, wherein at least one of the light-insensitive upper layers has a melting time longer than a melting time of the light-sensitive silver halide emulsion layer and at least one of the light-insensitive upper layers contains a polymer latex, wherein the polymer latex is a polymer latex having a glass transition temperature higher than room temperature, whereby antiadhesive property is improved.

2. A silver halide photographic light-sensitive material for photo-mechanical process as claimed in claim 1, wherein the melting time of the light-insensitive upper layer measured in a 0.2N NaOH solution kept at 75° C.

is at least 50 seconds longer than the melting time of the light-sensitive silver halide emulsion layer.

3. A silver halide photographic light-sensitive material for photo-mechanical process as claimed in claim 1, wherein the melting time of the light-insensitive upper layer measured in 0.2N NaOH solution kept at 75° C. is at least 100 seconds longer than the melting time of the light-sensitive silver halide emulsion layer.

4. A silver halide photographic light-sensitive material for photo-mechanical process as claimed in claim 1, wherein the polymer latex is a hydrate of a vinyl polymer containing a monomer unit selected from an acrylic acid ester, a methacrylic acid ester and styrene.

5. A silver halide photographic light-sensitive material for photo-mechanical process as claimed in claim 4, wherein the vinyl polymer is a homopolymer of alkyl acrylate or alkyl methacrylate or a copolymer of alkyl acrylate or alkyl methacrylate and other vinyl monomer.

6. A silver halide photographic light-sensitive material for photo-mechanical process as claimed in claim 1, wherein an average particle size of the polymer latex is from 0.005$\mu$ to 1$\mu$.

7. A silver halide photographic light-sensitive material for photo-mechanical process as claimed in claim 1, wherein the polymer latex is a hydrate of a homopolymer of methyl methacrylate, ethyl methacrylate or styrene or a copolymer of methyl methacrylate, ethyl methacrylate or styrene and another vinyl monomer.

8. A silver halide photographic light-sensitive material for photo-mechanical process as claimed in claim 1, wherein an amount of the polymer latex is from 5% to 200% based on the weight of hydrophilic colloid contained in the layer to be added.

9. A silver halide photographic light-sensitive material for photo-mechanical process as claimed in claim 1, wherein the polymer latex is present in the light-insensitive upper layer having a melting time longer than the melting time of the light-sensitive silver halide emulsion layer.

10. A silver halide photographic light-sensitive material for photo-mechanical process as claimed in claim 1, wherein the polymer latex is present in a light-insensitive upper layer other than the light-insensitive upper layer having a melting time longer than the melting time of the light-sensitive silver halide emulsion layer.

11. A silver halide photographic light-sensitive material for photo-mechanical process as claimed in claim 1, wherein the light-insensitive upper layer is hardened with a diffusion-resistant hardener.

12. A silver halide photographic light-sensitive material for photo-mechanical process as claimed in claim 1, wherein the light-insensitive upper layer is hardened with a polymeric hardener.

13. A silver halide photographic light-sensitive material for photo-mechanical process as claimed in claim 12, wherein the polymeric hardener has a repeating unit represented by the following general formula (I):

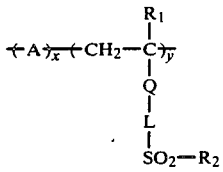

(I)

wherein A represents an ethylenically unsaturated monomer unit copolymerizable with a monomer unit set forth on the right side; $R_1$ represents a hydrogen atom or a lower alkyl group having from 1 to 6 carbon atoms; Q represents

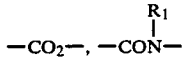

(wherein $R_1$ has the same meaning as defined above) or an arylene group having from 6 to 10 carbon atoms; L represents a divalent group having from 3 to 15 carbon atoms and containing at least one linking group selected from the members consisting of

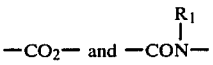

(wherein $R_1$ has the same meaning as defined above) or a divalent group having from 1 to 12 carbon atoms and containing at least one linking group selected from the members consisting of

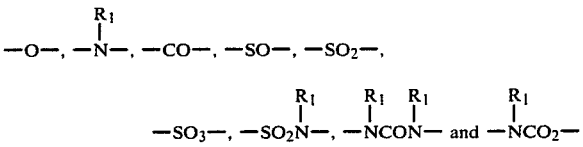

(wherein $R_1$ has the same meaning as defined above); $R_2$ represents $-CH=CH_2$ or $-CH_2CH_2X$ (wherein X represents a group capable of being substituted with a nucleophilic group or a group capable of being released in the form of HX upon a base); and x and y each represents molar percent, x being from 0 to 99 and y being from 1 to 100.

14. A silver halide photographic light-sensitive material for photo-mechanical process as claimed in claim 12, wherein the polymeric hardener has a repeating unit represented by the following general formula (II):

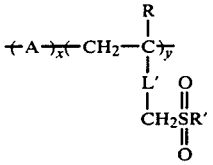

(II)

wherein A represents an ethylenically unsaturated monomer unit copolymerizable with a monomer unit set forth on the right side; x and y each represents molar percent, x being from 10 to 95 and y being from 5 to 90; R represents a hydrogen atom or an alkyl group having from 1 to 6 carbon atoms; R′ represents $-CH=CH_2$ or $-CH_2CH_2X$ (wherein X represents a group capable of being substituted with a nucleophilic group or a group capable of being released in the form of HX upon a base); and L′ represents a linking group selected from the members consisting of an alkylene group having from 1 to 6 carbon atoms, an arylene group having from 6 to 12 carbon atoms, —COZ— or —$COZR_3$— (wherein $R_3$ represents an alkylene group having from 1 to 6 carbon atoms or an arylene group having from 6 to 12 carbon atoms and Z represents an oxygen atom or NH).

15. A silver halide photographic light-sensitive material for photo-mechanical process as claimed in claim 12, wherein the polymeric hardener has a repeating unit represented by the following general formula (III):

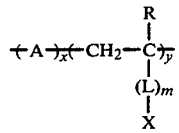

(III)

wherein A represents an ethylenically unsaturated monomer unit copolymerizable with a monomer unit set forth on the right side; R represents a hydrogen atom or an alkyl group having from 1 to 6 carbon atoms; L represents a divalent linking group having from 1 to 20 carbon atoms and containing at least one linking group selected from the members consisting of —CONH— and —CO—; X represents an active ester group; x and y each represents molar percent, x being from 0 to 95 and y being from 5 to 100; and m represents 0 or 1.

16. A silver halide photographic light-sensitive material for photo-mechanical process as claimed in claim 1, wherein the light-insensitive upper layer and the light-sensitive silver halide emulsion layer are hardened with a diffusible low molecular hardener.

17. A silver halide photographic light-sensitive material for photo-mechanical process as claimed in claim 1, wherein the light-insensitive upper layer is hardened with a polymeric hardener and the light-sensitive silver halide emulsion layer and the light-insensitive upper layer is hardened with a diffusible low molecular hardener.

18. A silver halide photographic light-sensitive material for photo-mechanical process as claimed in claim 1, wherein a coating amount of a hydrophilic colloid binder in the light-insensitive upper layer is equal to or more than that in the light-sensitive silver halide emulsion layer.

19. A silver halide photographic light-sensitive material for photo-mechanical process as claimed in claim 1, wherein a thickness of the light-insensitive upper layer is from $0.3\mu$ to $5\mu$.

20. A silver halide photographic light-sensitive material for photo-mechanical process as claimed in claim 1, wherein a ratio by weight of a hydrophilic colloid binder to silver halide in the light-sensitive silver halide emulsion layer is $\frac{1}{2}$ or less.

21. A silver halide photographic light-sensitive material for photo-mechanical process as claimed in claim 1, wherein silver halide is present in an amount of from 1.0 to 6.0 g silver/$m^2$ in the light-sensitive silver halide emulsion layer.

22. A silver halide photographic light-sensitive material for photo-mechanical process as claimed in claim 1, wherein silver halide is present in an amount of from 1.3 to 4.0 g silver/$m^2$ in the light-sensitive silver halide emulsion layer.

23. A method of reduction treatment for a silver halide photographic light-sensitive material for photo-mechanical process comprising the steps of:

exposing a silver halide photographic light-sensitive material, wherein the silver halide photographic light-sensitive material comprises a support having thereon at least one light-sensitive silver halide emulsion layer and at least one light-insensitive upper layer which is positioned above the light-sensitive silver halide emulsion layer, wherein at least one of the light-insensitive upper layers has a melting time longer than a melting time of the light-sensitive silver halide emulsion layer and at least one of the light-insensitive upper layers contains a polymer latex, wherein the polymer latex is a polymer latex having a glass transition temperature higher than room temperature, whereby anti-adhesive property is improved, development processing the exposed silver halide photographic light-sensitive material to form a silver image, and carrying out reduction treatment of the silver image.

24. A method of reduction treatment as claimed in claim 23, wherein the developing step is carried out using a lith type developing solution.

25. A method of reduction treatment as claimed in claim 23, wherein the reduction treatment step is carried out using a reducer containing a permanganate, a persulfate, a ferric salt, a cupric salt, a ceric salt, a ferricyanide or a dichromate.

26. A silver halide photographic light-sensitive material for photo-mechanical process as claimed in claim 1, wherein the average particle size of the polymer latex is from $0.02\mu$ to $0.1\mu$.

27. A silver halide photographic light-sensitive material for photo-mechanical process as claimed in claim 1, wherein the amount of the polymer latex is from 10 to 100 percent based on the weight of hydrophilic colloid contained in the layer to which it is added.

* * * * *